United States Patent [19]

Nishikawa et al.

[11] Patent Number: 4,733,270

[45] Date of Patent: Mar. 22, 1988

[54] MULTI-COLOR IMAGE RECORDING APPARATUS CAPABLE OF REMOVING A RECORDED-ON ROLL MEDIUM, WITHOUT UNROLLING

[75] Inventors: Masaji Nishikawa; Masashi Asano; Atsushi Yagi, all of Tokyo, Japan

[73] Assignee: Olympus Optical Co., Ltd., Tokyo, Japan

[21] Appl. No.: 45,125

[22] Filed: Apr. 30, 1987

[30] Foreign Application Priority Data

May 15, 1986 [JP] Japan ..... 61-111134

[51] Int. Cl.[4] ..... G03G 15/01

[52] U.S. Cl. ..... 355/4; 355/13; 355/32; 346/157

[58] Field of Search ..... 355/4, 13, 16, 27, 28, 355/29, 32; 346/153.1, 157; 354/313, 319

[56] References Cited

U.S. PATENT DOCUMENTS

| | | | |
|---|---|---|---|
| 3,848,990 | 11/1974 | Otubo et al. | 355/4 |
| 3,879,122 | 4/1975 | Wick et al. | 355/4 |
| 3,976,372 | 8/1976 | Miyata | 355/4 |
| 4,239,370 | 12/1980 | Kurita | 355/4 |
| 4,286,031 | 8/1981 | Kuehnle et al. | 355/4 X |
| 4,569,584 | 2/1986 | St. John et al. | 346/157 X |
| 4,647,182 | 3/1987 | Pierce | 355/4 |

OTHER PUBLICATIONS

Proceedings of First Non-Impact Printing Technologies Symposium, "Electrostatic Color Plotter System", Tetsuro Morino, 1984, pp. 101-104.

*Primary Examiner*—R. L. Moses

*Attorney, Agent, or Firm*—Frishauf, Holtz, Goodman & Woodward

[57] ABSTRACT

An image-forming/processing station forms images in a plurality of colors in a superposed manner, in units of individual colors, on an identical unrolled portion of a recording roll medium, in accordance with color image formation data. When the images in the plurality of colors are to be formed, a recording medium conveying unit reciproctes, a plurality of times, the identical unrolled portion of the recording roll medium to the image-forming/processing station, in accordance with formation of the image in the plurality colors, and conveys a recorded-on unrolled portion of the recording roll medium to a downstream side of the station when formation of the images in the plurality of colors is completed. A recording medium storing unit is provided on the downstream side of the station and temporarily stores the unrolled portion of the recording roll medium on which image formation in each color is to be performed. A recording medium discharging unit is provided on the downstream side of station means and discharges the unrolled portion of the recording roll medium on which image formation in each color has been performed. A switching unit is provided on the downstream side of the station, which can be switched between first and second positions, for guiding the unrolled portion of the recording roll medium toward the storing unit or the discharging unit.

10 Claims, 15 Drawing Figures

MULTI-COLOR IMAGE RECORDING APPARATUS CAPABLE OF REMOVING A RECORDED-ON ROLL MEDIUM, WITHOUT UNROLLING

BACKGROUND OF THE INVENTION

This invention relates to a multi-color image recording apparatus which can remove a recorded-on roll medium without unrolling, which is suitable as a color image recording apparatus for recording a color image on conveyed recording roll paper, by use of a color image-forming/processing station which includes a recording head.

An exampe of such a conventional color image recording apparatus is an electrostatic color plotter. In such as electrostatic color plotter, a recording roll medium is reciprocated in relation to an image-forming/-processing station comprising a plurality of developing units or the like, each using a developer for a different color and a single recording head, and multi-color images are superposed and formed on a single surface portion of the recording medium.

For example, FIG. 1 shows the arrangement of an electrostatic color plotter reported on page 101 of Articles of 1st Non-Impact Printing Technique Symposium sponsored by the Electrophotographic Academy of Japan and available as Model ECP-42 from Versatech Inc., U.S.A. Referring to FIG. 1, electrostatic recording roll medium (to be referred to as recording paper hereinafter) 1 is wound on feed roller 2. The plotter further comprises write head 3 with a servo mechanism, rear electrode 4 of head 3, developing heads 5 to 8 using liquid developers for different colors, paper feed roller 9 with a servo mechanism, take-up roller 10 for taking up recorded-on paper 1, memory boards 11 to 14 for storing recording data, and controller 15 for supplying image data to head 3 and controlling the operation of the overall apparatus.

When image recording is performed, recording paper 1 is supplied from feed roller 1 to take-up roller 10, via the processing station including the write and developing heads and paper feed roller 9. Recording is performed while paper 1 is conveyed to the right in FIG. 1. One of developing heads 5 to 8 is moved upward and set at an operative position, and an electrostatic latent image of a predetermined image is formed by write head 3 and developed by the developing head which has been moved upward. The supplying of recording paper 1 continues until the recording of an image in one color is completed, and is then taken up to a start position. Recording in the next color is performed similarly by moving upward a developing head of another color. When recording in three primary colors or four colors including the three primary colors plus black is completed, recorded-on paper 1 is taken up by take-up roller 10, and the next image is recorded on the immediately following portion of paper 1.

In the above conventional apparatus, the recorded-on paper is sequentially wound on take-up roller 10. When a portion of recorded-on paper is to be removed, recording paper 1 must be cut at a portion between paper feed roller 9 and take-up roller 10, and recorded-on paper 1 must be unrolled from roller 10 and cut, in units of images, by use of a manual operation. However, since a plotter often outputs a large number of images, it is not easy to unroll and cut paper 1 by way of a manual operation. The apparatus having the arrangement as shown in FIG. 1 is thus very inconvenient to use when a portion of recorded-on paper is to be removed or cut. When a small number of images is recorded, although recorded-on paper 1 can be cut and removed after every recording, non-recorded-on paper 1 must be rewound on roller 10 after cutting. This entails a cumbersome operation and thus causes considerable inconvenience, since a large amount of recording paper is unnecessarily consumed without having been recorded on.

SUMMARY OF THE INVENTION

It is, therefore, an object of the present invention to provide a new and improved multi-color image recording apparatus which is capable of removing a recorded-on roll medium without having to perform unrolling, thereby facilitating the removal of a recorded-on roll medium even after a large number of images have been recorded, and which greatly decreases the amount of recording roll medium which is consumed unnecessarily without having been recorded on.

According to the present invention, a multi-color image recording apparatus is provided, comprising:

image-forming/processing station means for forming images in a plurality of colors in a superposed manner, in units of individual colors, on an identical unrolled portion of a recording roll medium, in accordance with color image formation data;

recording medium conveying means for reciprocating a plurality of times, when the images in the plurality of colors are to be formed, the identical unrolled portion of the recording roll medium in relation to the image-forming/processing station means, in accordance with formation of the image in the plurality of colors, and conveying a recorded-on unrolled portion of the recording roll medium to a downstream side of said image-forming/processing station means when image formation in the plurality of colors is completed;

recording medium storing means, provided on the downstream side of the image-forming/processing station means, for temporarily storing the unrolled portion of the recording roll medium on which image formation in each of the plurality of colors is to be performed;

recording medium discharging means, provided on the downstream side of the image-forming/processing station means, for discharging the unrolled portion of the recording roll medium on which image formation in each of the plurality of colors has been performed; and switching means, provided on the downstream side of the image-forming/processing station means, which can be switched between first and second positions, the first position being a position for guiding the unrolled portion of the recording roll medium toward the recording medium storing means when image formation in the plurality of colors is performed, and the second position being a position for guiding the unrolled portion of the recording roll medium toward the recording medium discharging means when image formation in the plurality of colors is completed.

BRIEF DESCRIPTION OF THE DRAWINGS

These and other objects and features of the present invention can be understood through the following embodiments by reference to the accompanying drawings, in which.

DETAILED DESCRIPTION OF THE PREFERRED EMBODIMENTS

Figure 2:
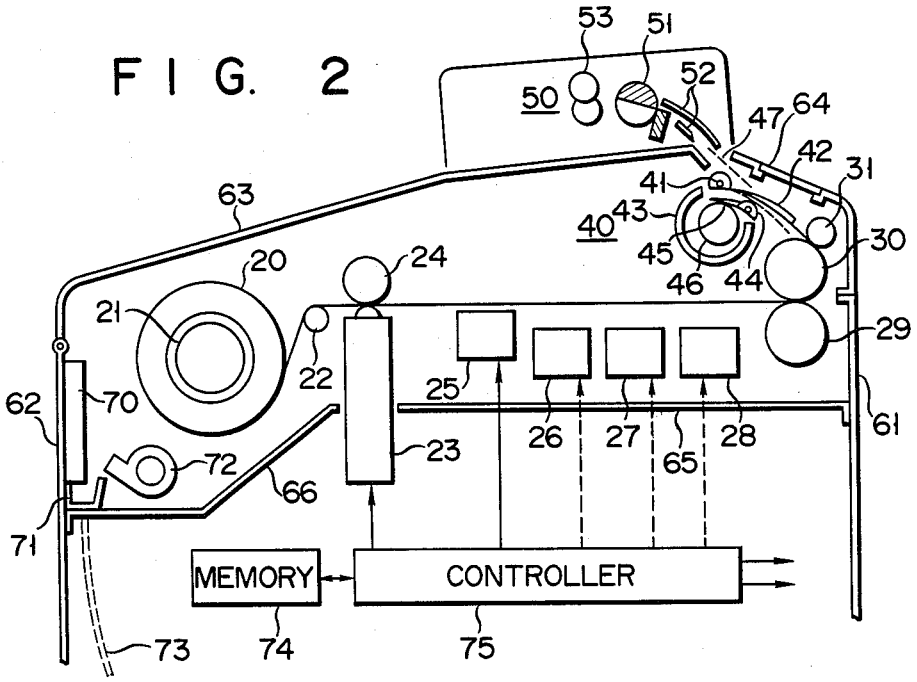
FIG. 2 is a side view of the arrangement of the apparatus according to a first embodiment of the present invention from which a cover portion is removed.

FIG. 2 shows an embodiment of the present invention. Referring to FIG. 2, reference numeral 20 denotes a recording roll medium (to be referred to as recording paper hereinafter); 21, a recording paper feed roller; 22, a guide roller; 23, a multistylus electrostatic recording head; 24, a pressure roller; 25 to 28, developing heads using liquid developers of different colors; and 29, 30, and 31, recording paper convey rollers.

Reference numeral 40 denotes an automatic roll-in storing section having pivot support shaft 41, recording paper guide plate 42, cylindrical guide plate 43, support shaft 44, roll-in guide plate 45, roll-in roller 46, and recording paper discharge path 47.

Reference numeral 50 denotes an auto cutter having rotary cutter 51, guide plate 52, and roller cutter 53.

Reference numerals 61 and 62 denote side covers; 63, an opening/closing cover; 64, a window; and 65 and 66, partition plates.

Reference numeral 70 denotes an electronic cooler comprising, e.g., a Peltier effect element; 71, a water drainage container; 72, a blower; 73, a water discharge pipe; 74, a memory for storing recording data; and 75, a controller for supplying image data to recording head 23 and controlling the overall apparatus in a required manner.

Rotating means such as motors, although omitted in FIG. 2, are provided to recording paper feed roller 21, recording paper convey roller 30, roll-in roller 46, and so on and constitute means for reciprocating recording paper 20. Recording head 23 and developing heads 25 to 28 constitute an image-forming/processing station.

Prior to the start of recording, recording paper 20 is unrolled from feed roller 21 and guided to recording paper convey rollers 29, 30, and 31 through the image-forming/processing station such that its leading end is located at a position slightly before guide plate 42, that constitutes a guide means, exceeding a nip portion between rollers 30 and 31. One end of plate 42 is supported by pivot support shaft 41 and can be switched between positions indicated by solid and broken lines in FIG. 2 by a drive mechanism (not shown) such as a plunger. Normally, plate 42 is set at the position indicated by the solid line.

When recording is performed, a recording signal voltage is applied to recording head 23 while conveying recording paper 20 to the right, and one of developing heads 25 to 28, e.g., developing head 25 is moved upward and set in an operative state, thereby allowing recording and development of a latent image on paper 20. The leading end of paper 20 is taken up by roll-in roller 46 rotating counterclockwise and temporarily stored in automatic recording paper roll-in storing section 40. When recording of one image in a first selected color is completed, paper 20 is stopped, and head 25 is moved downward and set in an inoperative state. Subsequently, paper 20 is fed to the right and taken up by feed roller 21. When the leading end of paper 20 reaches a portion slightly exceeding the nip between recording paper convey rollers 30 and 31, reverse paper feeding is stopped. Paper 20 is then fed to the right again from this state, and image recording in a second color is performed. In this case, in order to superpose an image in a different color on the first image, a developing head using a liquid developer of the different color is moved upward and set operative, a recording signal voltage corresponding to the different color is supplied to recording head 23, and recording is performed by repeating the same process as described above.

Before the start of a process for forming an image in a final color, guide plate 42 is switched and set at the position indicated by the broken line. When recording is started, the leading end of recording paper 20 moves toward recording paper discharge path 47, and a portion of paper 20 on which recording has been performed is discharged to outside cover 63 as the recording proceeds. Discharged paper 20 is guided by guide plate 52, cut in the lengthwise direction by rotary cutter 51 of auto cutter 50, and cut in the widthwise direction by rotary cutter 53 thereof. In multi-color image formation, after the trailing end of a recorded image passes the developing unit, the recording paper is fed to a position ahead of the developing unit by a slight distance, and is taken up again. When image formation in a final color is performed, the trailing end of the recorded image is fed to the operative region of the cutter as the cutting position of paper 20, that is, to the position of the blades of rotary cutter 51, and is stopped. When auto cutter 50 is not provided, paper 20 can be cut outside discharge path 47. This cut position is the recording paper cut position.

With the arrangement shown in FIG. 2, when a multi-color superposed image is formed, recorded paper 20 can be discharged to outside the apparatus as a paper sheet. It is thus quite easy to cut paper 20 to a predetermined size by auto cutter 50 or manual operation without any cumbersome operation. Also, since paper 20 need not be wound on a take-up roller before recording, a portion of paper 20 unnecessarily consumed without image recording can be minimized. When a large number of recording images is to be formed, the operability of the apparatus is considerably superior to the conventional apparatus since paper 20 can be automatically cut by auto cutter 50.

Automatic recording paper roll-in storing section 40 is very important in the apparatus of this embodiment. More particularly, in the conventional apparatus, recorded image portions are sequentially taken up by a take-up roller and it is thus difficult to remove the recorded image portions one at a time or to cut and remove a recorded image portion.

Similarly, in the conventional monochromatic electrostatic plotter, recorded paper is merely fed outside the apparatus through the discharge path. Therefore, when an apparatus for forming a multi-color image by reciprocating recording paper is to be manufactured to have the arrangement of this embodiment, as the length of a recorded image is increased, discharge and taking up of the recording paper cannot be smoothly performed.

According to the present invention, since automatic recording paper roll-in storing section 40 is provided for temporarily storing recording paper during recording, the conventional problems or drawbacks described above are eliminated.

Furthermore, in the apparatus of the present invention, recording paper 20 is surrounded by surrounding members constituted by covers 61 to 63, window 64, and partition plates 65 and 66, in a path from feed roller 21 to recording paper storing section 40 through the image forming section, excluding recording paper discharge path 47. Since the surrounding members are provided with a dehumidifying means comprising electronic cooler 70, water drainage container 71, blower 72, and water discharge pipe 73, the constituent members of the recording unit, such as recording paper 20 and developing heads 25 to 28, can be protected from a high-humidity atmosphere before and during recording, and recording can be performed stably. Particularly, since the size of recording paper can be prevented from changing, color misregistration of a superposed color image can be prevented. This arrangement is filed as U.S. patent application Ser. No. 876,831 (filing date: June 20, 1985, Title: Image Forming Apparatus Including Means for Dehumidifying) by the same assignee of the present invention.

In FIG. 2, when an image of the final color is formed during recording of a single image, recording paper 20 is supplied to paper discharge path 47. However, paper 20 can be stored in automatic recording paper roll-in storing section 40 during formation of an image of a final color, the leading end of the recording paper can be returned to a portion near the nip portion between convey rollers 30 and 31 after recording of the single image is completed, guide plate 42 can be switched to the position indicated by the broken line, and then recording paper can be supplied to discharge path 47. In this case, electrical and mechanical troubles occurring from the operation of the cutter during image recording can be completely prevented.

The embodiment shown in FIG. 2 has various advantages compared to a conventional multi-color image recording apparatus which takes up recorded paper on a take-up roller. When auto cutter 50 is provided in this embodiment, an apparatus having a considerably good operability can be realized. FIGS. 3A to 3E are views for explaining practical operation states of this case.

Referring to FIGS. 3A to 3E, portions indicated by broken lines correspond to the respective constituent elements of the multi-color image recording apparatus shown in FIG. 2 and are shown in a simplified manner. The solid line indicates recording paper 20, and thick arrows A and B indicate leading and trailing ends of an image forming region, respectively.

Figure 3A:
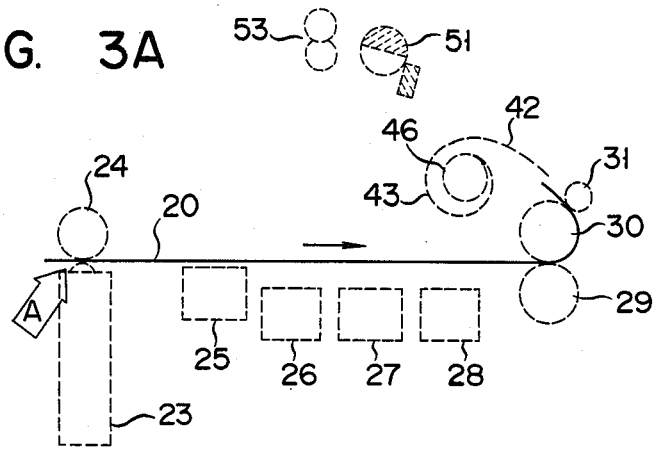
FIGS. 3A to 3E show, in detail, recording paper feed control of the same.

FIG. 3A shows a state wherein recording paper 20 is set and recording can be started. The leading end of recording paper 20 is located at a position before the guide means on a downstream side of the nip portion between recording paper convey rollers 30 and 31. Arrow A indicates the leading end of an image forming region. A portion of recording paper 20 ahead of the leading end of the image forming region is consumed without image recording.

Figure 3B:
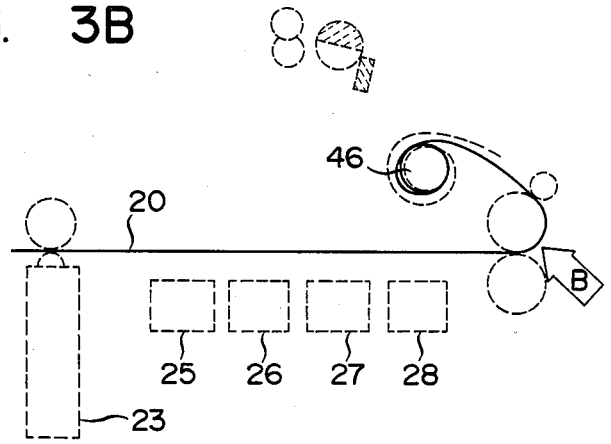

FIG. 3B shows a state wherein image formation in a first color is completed and recording paper 20 is stopped. Arrow B indicates the trailing end of the image forming region. Most of the image recorded portion is taken up by roll-in roller 46 of automatic recording paper roll-in storing section 40. In some cases, the recording paper can be drawn and dried by a suction/dryer head (not shown) after the trailing end of the recording image passes the developing head section. In some other cases, a developer can undesirably attach to recording paper 20 and contaminate it after development by a developing head and before stopping and downward movement thereof. Therefore, this dried or contaminated portion of recording paper 20 is set as a recording margin and recording paper 20 is fed for some distance after it passes the developing head section.

When images of other colors are to be superposed, an operation of returning recording paper 20 to the position shown in FIG. 3A and feeding it to the position shown in FIG. 3B, while forming an image, is repeated.

Figure 3C:
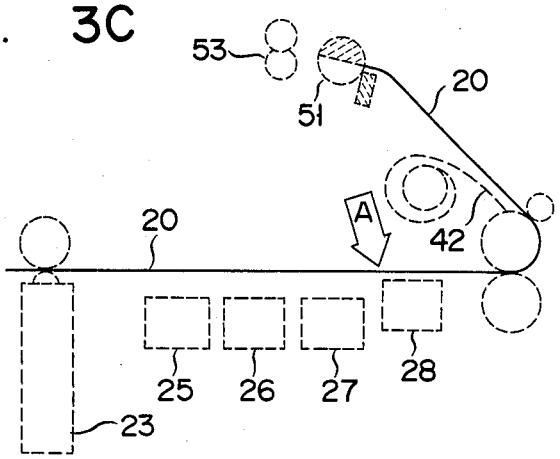

FIG. 3C shows a state wherein image forming in a final color is being performed. Guide plate 42 is moved to the illustrated position, and recording paper 20 is conveyed toward cutters 51 and 53 via discharge path 47. Arrow A indicates the leading end of the image forming region. The leading end of the image forming region of recording paper 20 is cut first, and then the trailing end is cut in the later step.

Figure 3D:
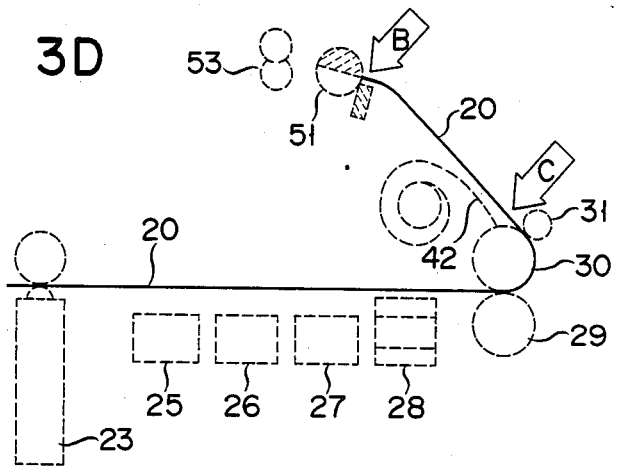
Figure 3E:
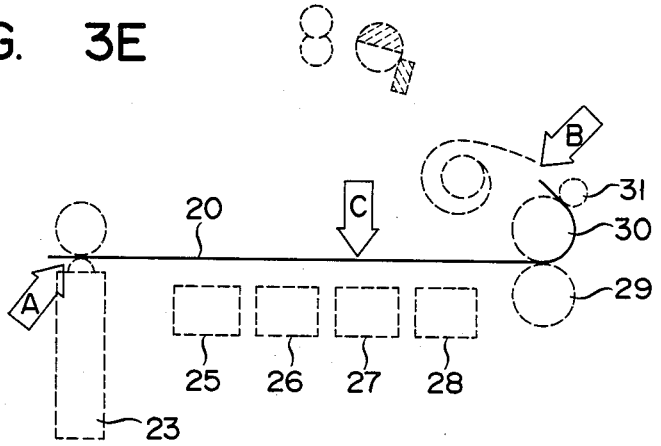

FIG. 3D shows a state wherein image forming in a final color is completed and recording paper 20 has been fed to cutter 51 in order to cut its trailing end portion. In this case, the position of the portion before guide plate 42 on the downstream side of the nip portion between convey rollers 30 and 31, which is indicated by arrow C, is the position where the leading end of recording paper 20 was originally set. If recording is completed in this state, the following inconveniences arise. Firstly, the portion of recording paper 20 between arrows B and C is unnecessarily consumed without image recording. Secondly, in this state the leading end of paper 20 cannot be guided to storing section 40 via guide plate 42.

In order to remove these inconveniences, with the present invention, recording paper 20 is cut at the trailing end (indicated by arrow B) of an image and is rewound such that the leading end (indicated by arrow B) of the cut roll medium is located between the nip portion between convey rollers 30 and 31, and guide plate 42, and thereafter next image recording is performed. As a result, the leading end of paper 20 is guided into storing section 40 via guide plate 42, and the portion of paper 20 which is consumed without image recording can be reduced.

The second embodiment of the present invention will be described. In recording paper feed control of the first embodiment shown in FIGS. 3A to 3E, a portion of paper 20 present on a recording paper path extending from recording head 23 to the nip portion between convey rollers 30 and 31 is consumed without image recording. This poses a problem since it inevitably happens in each image formation and this problem must be solved.

In the present invention, a recording paper convey control means is provided for minimizing, when a plurality of images are to be continuously formed, the size of the non-recorded portion between images of the recording paper which is consumed without forming an image.

More specifically, a recording paper convey roller, a recording paper guide means, an automatic recording paper roll-in storing section for storing recording paper recording two images, and a recording paper discharge path are provided on the downstream side of the image-forming/processing station. Two multi-color images are formed as recording paper is guided to the automatic recording paper roll-in storing section via the recording paper guide means. Then, the recording paper path is switched to the recording paper discharge path side by the recording paper guide, only the first image portion of the paper is cut and removed, the guide means is moved again to guide the recording paper to the automatic recording paper roll-in storing section, and the next image is recorded. Cutting of the first image portion and recording of the second image are repeated.

FIGS. 4A to 4F are views showing recording paper feed control of the second embodiment. Recording paper storing section 40 shown in FIGS. 4A to 4F has a space sufficient for storing a portion of recording paper 20 recording two images. The process of initial setting of paper 20 and formation of a first image is the same as FIGS. 3A and 3B. Image formation in a final color for the first image is performed in a similar manner to image formation in each previous color. The state after image formation in the final color is the same as that of FIG. 3B. When the second image is to be recorded, it is performed without cutting the first image.

Figure 4A:
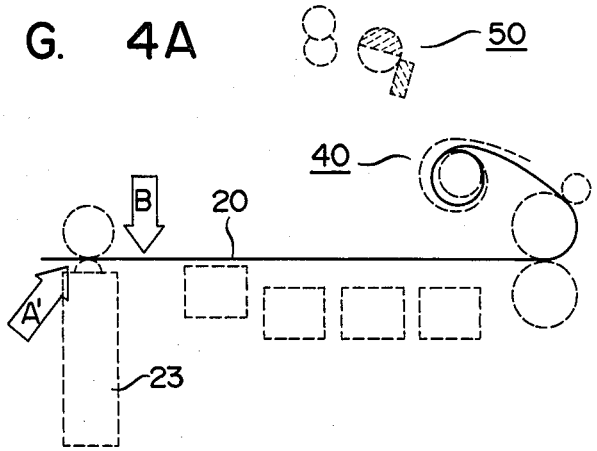
FIGS. 4A to 4F show, in detail, recording paper feed control according to a second embodiment of the present invention.

FIG. 4A shows a state wherein recording paper 20 is rewound prior to the start of recording of the next image and stopped such that the trailing end of the first image is located near recording head 23. Referring to FIG. 4A, arrow B indicates the trailing end of the first image, and arrow A' indicates the leading end of the second image. In this case, part of the first image is stored in recording paper storing section 40.

Figure 4B:
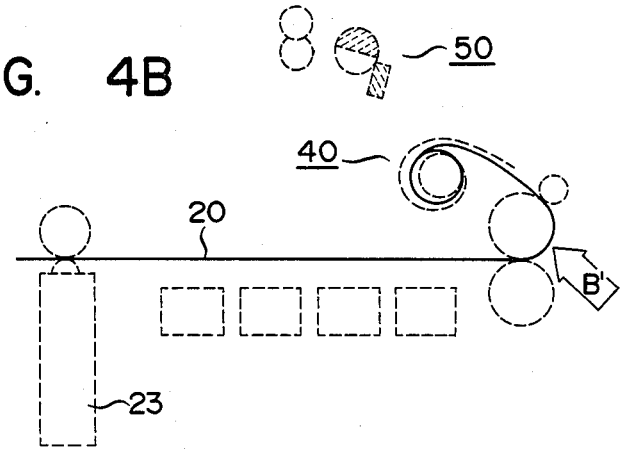

FIG. 4B shows a state wherein recording of the second image is started from the above state and recording in the first color of the second image is completed. Arrow B' indicates the trailing end of the second image. Image formation in the next color is performed while rewinding recording paper 20 to the position shown in FIG. 4A and subsequently feeding it to the position shown in FIG. 4B.

Figure 4C:
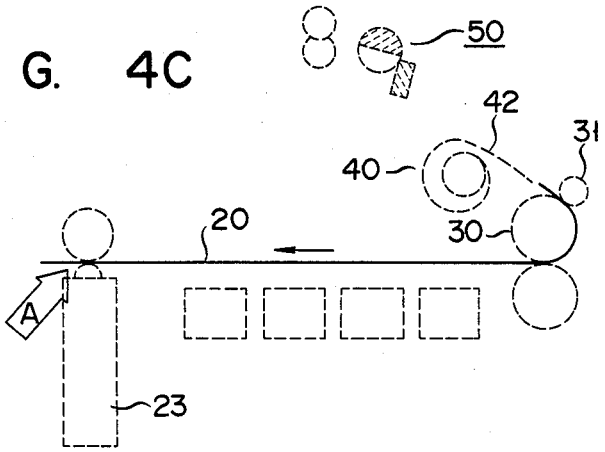

FIG. 4C shows a state wherein, after an image of the final color of the second image is formed in this manner, recording paper 20 is rewound in order to cut the first image portion and stopped, such that the leading end of the first image is located at recording head 23, and at the same time the leading end of recording paper 20 appears from recording paper storing section 40 and is located at a portion slightly downstream the nip portion between convey rollers 30 and 31. And guide plate 42 is switched to guide paper 20 onto the discharge path.

Figure 4D:
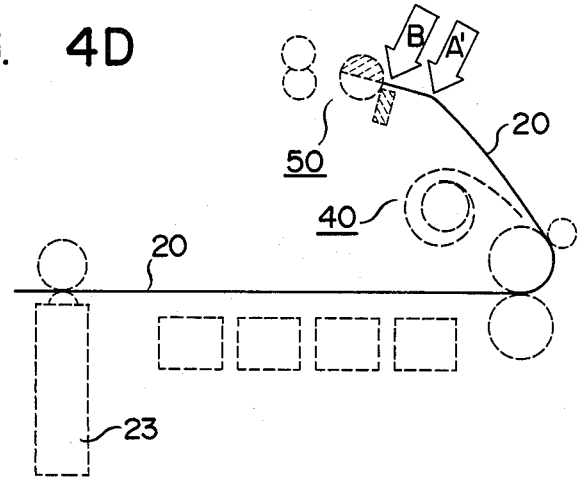

FIG. 4D shows a state after the leading and trailing end portions of the first image of recording paper 20 are supplied to cutter 50 and cut. Arrow B indicates the trailing and of the first image, and arrow A' indicates the leading end of the second image.

Figure 4E:
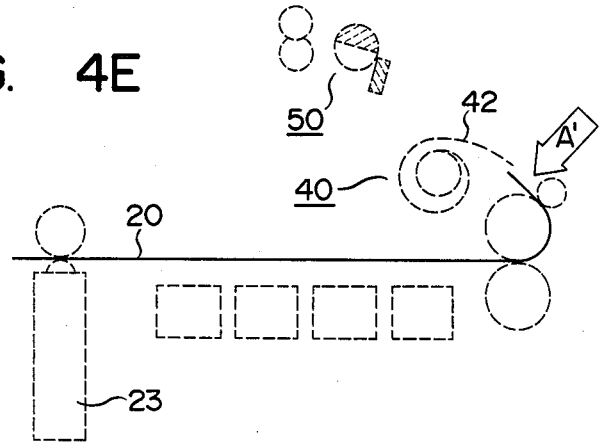

FIG. 4E shows a state wherein cut recording paper 20 is rewound such that its leading end is located at the inlet port of guide plate 42 and plate 42 is set in the initial position in order to prepare for the next recording.

Figure 4F:
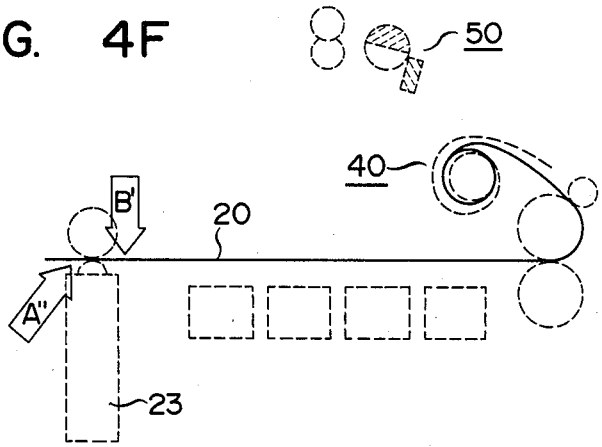

FIG. 4F shows a state wherein the leading end of a third image is located at recording head 23 and formation of the third image is to be started from this position. Arrow B' indicates the trailing end of the second image, and arrow A" indicates the leading end of the third image. In this case, part of the second image is stored in recording paper storing section 40, and the state similar to that of FIG. 4A is obtained.

In the examples shown in FIGS. 4A to 4F, when no following image exists, it is preferable that the recorded image portion is fed out and cut to obtain the state as shown in FIG. 3A, and operation of the apparatus is stopped.

In this manner, according to the second embodiment, image recording of the second image and cutting of the first image are repeated while constantly leaving one-image portion uncut, thus continuing recording. A non-recorded recording paper portion which is consumed without forming an image thereon can be minimized.

When a processing station such as developing heads 25 to 28 is provided between recording head 23 and convey rollers 29, 30, and 31, as in this apparatus, a long recording paper convey path exists between head 23 and rollers 29, 30, and 31. In order to convey recording paper 20, the recording paper path extending from head 23 to the roller section must have a lead portion. In the examples of FIGS. 4A to 4F, the portion of the first image is used as the lead portion for the second image, thereby minimizing the unnecessarily consumption of recording paper without image recording.

The third embodiment of the present invention will be described. In the first and second embodiments, the recording paper discharge path must be switched while cut recording paper 20 is rewound to the inlet port of guide plate 42. However, when the locations of cutter 50 and recording paper storing section 40 and the arrangement of the guide means are changed, the recording paper discharge path can be switched to the recording paper storing section side without winding cut paper 20. A practical example of the third embodiment will be described.

Figure 5:
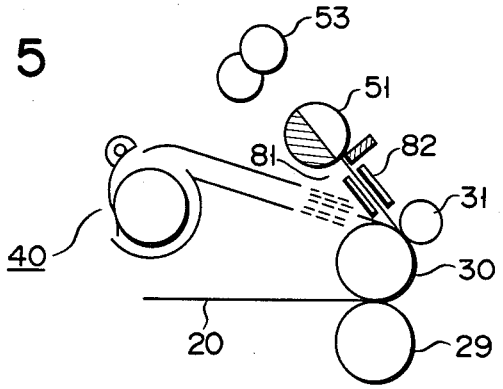
FIGS. 5 and 6 are side views showing, respectively, a main portion of third and fourth embodiments of the present invention.

FIG. 5 shows the third embodiment of the present invention, in which only the arrangement of the members on the downstream side of recording paper convey roller 29 shown in FIG. 2 is illustrated. Reference numeral 81 denotes a recording paper discharge path; and 82, guide plates. Guide plates 82 can be switched at the positions indicated by solid and broken lines. When recorded paper 20 is to be cut, plates 82 are set at the position indicated by the solid lines and feed paper 20 toward cutters via discharge path 81. When paper is temporarily stored during recording, plates 82 are moved to the positions of the broken lines and feed paper 20 to automatic recording paper roll-in storing section 40.

The distal end of recording paper 20 cut by cutter 51, held by convey roller 30, is located near the blades of cutter 51. When guide plates 82 are to be moved from the positions indicated by the solid lines to those indicated by the broken lines, paper 20 is further wound on roller 30 and pulled between plates 82. Therefore, the leading end portion of paper 20 which is cut by cutter 51 can be directly guided to storing section 40 without rotating roller 30 in the rewinding direction. Thus, recording paper convey control can be greatly simplified compared to recording paper convey control explained in the first and second embodiments.

A section for switching the recording paper path can be modified for the purpose of shortening the recording paper path on the downstream side of the convey roller, or facilitating or centralizing the automatic recording paper roll-in storing section and the auto cutter. For example, since the automatic recording paper roll-in storing section includes a roll-in roller, it needs a large space. Also, the rotary cutter having a cutting line perpendicular to the recording paper feed direction has a size about the same as the storing section. Therefore, as one of the storing section and the rotary cutter is moved closer to the convey roller, as shown in FIGS. 2 and 5, the other must be moved farther from the convey roller, and a long convey path is required, thus increasing the size of the entire apparatus.

A fourth embodiment of the present invention solves this problem. According to the fourth embodiment, a Y cutter having a cutting line perpendicular to the recording paper feed direction is provided on the downstream side of a recording paper convey roller, and a recording paper guide means is provided on the further downstream side of the Y cutter. An automatic recording paper roll-in storing section is provided on one path of the recording paper guide means, and an X cutter having a cutting line parallel to the recording paper feed direction and a recording paper discharge port are provided on the other path thereof. During image formation, the recording paper is guided to the automatic recording paper roll-in storing section via the Y cutter and the guide means. After image formation, the recorded portion of the recording paper is guided to the X cutter and the recording paper discharge port via the Y cutter and the guide means.

Figure 6:
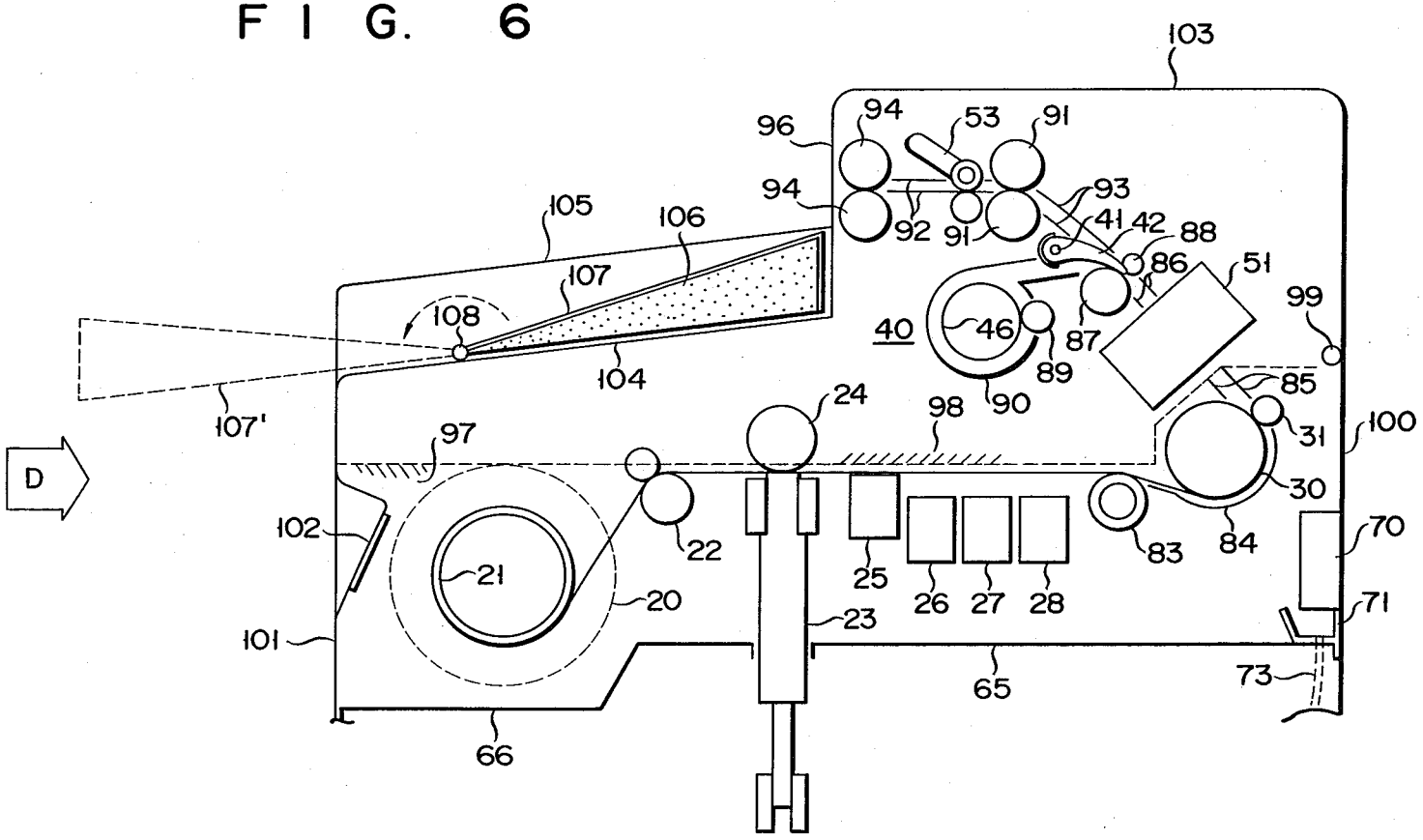

FIG. 6 shows the fourth embodiment of the present invention. The members denoted by the same reference numerals in FIG. 6 are identical to or have the same functions to those in FIG. 2. Referring to FIG. 6, reference numeral 83 denotes an absorbing/drying roller for absorbing an excess portion of the developer attached on the recording paper surface after completion of development and drying it. Reference numeral 84 denotes a recording paper set guide plate for guiding the recording paper when the recording paper is initially set on convey roller 30. Reference numerals 85, 86, 93, and 92 denote stationary guide plates, respectively; 87, 88, 91, and 94, respective guide rollers; and 89, a pressure roller for pressing roll-in roller 46. Reference numeral 98 denotes an upper frame; 99, a pivot support shaft thereof; 97, a lower frame; 100 and 101, lower covers; 102, a window formed in lower cover 101; 103, an upper rear cover; 104, an upper front cover; 106, a movable tray; 107, a recording paper reception surface; 105, an upper front cover side portion; and 96, a recording paper discharge port, respectively.

Y cutter 51 having a cutting line perpendicular to the recording paper feed direction is provided on the downstream side of recording paper convey roller 30, and recording paper guide plate 42 is provided on the further downstream side of cutter 51. Automatic recording paper roll-in storing section 40 is provided on one path of guide plate 42, and X cutter 53 having a cutting line parallel to the moving direction of recording paper 20 is provided on the other path thereof. Cutter 53 is connected to discharge port 96. When plate 42 is at the position shown in FIG. 6, paper 20 is guided toward storing section 40, fed by the rotation of pressure roller 89 and roll-in roller 46, and wound on roller 46 by the operation of guide plate 90. The peripheral speed of roller 46 is set to be slightly larger than the feed speed of paper 20. When a predetermined load is applied on roller 46, a slippage occurs between roller 46 and a drive source, or the rotating speed of the drive source is decreased, so that roller 46 can take up paper 20 without loosening and that can roll in paper 20 without causing any undersirable result even when the coil diameter of paper 20 taken up on roller 46 is increased. Pressure roller 89 is movable in the radial direction of roll-in roller 46 in order to cope with the increase in coil diameter of paper 20 on roller 46.

When the distal end of recording paper guide plate 42 is moved downward and received in a hollow formed in roller 87, the recording paper path is switched to the path connected to X cutter 53. Guide rollers 91 and 94 are provided on this path to guide recording paper 20 to cutter 53, discharge paper 20 from cutter 53, and guide it to the discharge port. X cutter 53 can comprise a disk blade that rotates at a high speed. A plurality of cutters 53 are provided at predetermined portions on the path in the widthwise direction of paper 20. These cutters are selectively vertically moved in response to a cutting instruction and cut paper 20 in the desired manner. Guide rollers 87, 91, and 94 are set such that those on the downstream side have larger peripheral speeds. The rotating speeds of the rollers are changed in accordance with a load. Cutters 87, 91, and 94 increase the intervals between the cut portions of recording paper 20 cut by Y cutter 51 in order to allow a time required for the vertical movement of X cutter 53.

During image formation, recording paper guide plate 42 is located at the position shown in FIG. 6. Printing is performed while the leading end of paper 20 which is at a position slightly on the downstream side of the nip between convey rollers 30 and 31 or at the cutting position of Y cutter 51 at the start of recording is rolled in automatic recording paper roll-in storing section 40. At the start of recording in the final color, or after recording in all the colors, guide plate 42 is moved downward to switch the recording paper path, paper 20 is cut, as it moves, in the direction perpendicular to the recording paper feed direction by Y cutter 51, and in the direction parallel to the recording paper feed direction by X cutter 53.

Tray 106 having pivot point 108 is provided below and before discharge port 96. Recording paper reception surface 107 of tray 106 is inclined so as to guide cut and discharged recording paper to allow it to slide on it and to fall before the apparatus. If a recording paper reception box is provided before the apparatus, a large amount of recorded paper can be stored.

When tray 106 is rotated counterclockwise through 180° , a large recording paper reception surface is formed, as indicated by a broken line, and the recording paper can be received in this portion.

In the above embodiment shown in FIG. 6, the automatic recording paper roll-in storing section having a large spatial space both in vertical and horizontal directions and the Y cutter can be easily arranged close to each other. Furthermore, the X cutter can be arranged above the storing section and the Y cutter, the recording paper discharge port can be provided at a high level to facilitate discharge of the paper, and the space occupied by the entire apparatus can be reduced, thereby realizing a compact apparatus.

Figure 1:
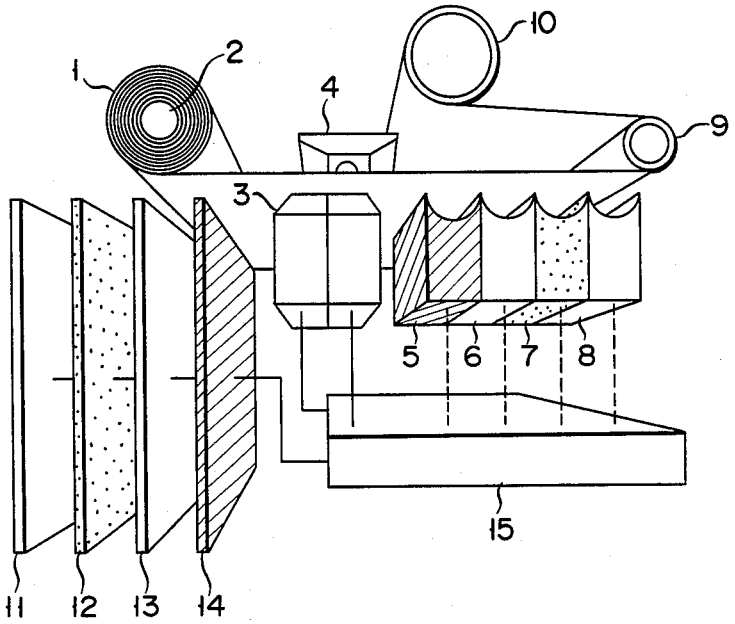
FIG. 1 (PRIOR ART)
FIG. 1 is schematic view showing a conventional multi-color image, recording apparatus.

In the conventional color image recording apparatus using a roll medium, when recording paper is to be set, the recording paper path is to be inspected, or recorded paper is to be removed, the operation positions are different and thus the apparatus is very inconvenient. For example, in the conventional apparatus shown in FIG. 1, usual operations are performed from the left side of the apparatus in the drawing and operation of the operation panel and observation of a recorded image are performed in this direction. Meanwhile, since recording roll medium 1 is heavy, it must be set in the apparatus from the opposite side to the above operation side, i.e., from the rear side of the apparatus. Also, since take-up roller 10 is away from the operation side, recording paper must be mounted from a side portion of the apparatus.

In the present invention, in order to eliminate these inconveniences arising from the different operation positions, operations are performed from a side opposite to the position of the opening/closing support shaft of the clam-shell structure. The members of the image-forming/processing station including the recording roll medium and the recording head are arranged in the clam shell lower stationary frame in this order from left to right in FIG. 6. The auto cutter mechanism, the discharge port, and the automatic recording paper roll-in storing section are provided in the clam shell upper open frame. The recorded paper is discharged toward the front side of the operation side, i.e., to the left in FIG. 6.

Referring to FIG. 6, arrow 0 indicates the operation side, and reference numeral 99 denotes an upper frame constituting the open side of the clam shell; 97, a lower frame of the stationary side; and 99, a pivot support shaft of the upper frame. Recording roll medium 21, guide roller 22, recording head 23, developing heads 25 to 28 of different colors, absorber/dryer roller 83, recording paper convey rollers 30 and 31, and guide plate 84 are arranged in the lower stationary frame in this order from left to right in FIG. 6. Y cutter 51, X cutter 53, automatic recording paper roll-in storing section 40, and recording paper guide plate 42 with guide rollers and guide plates are provided in the upper open frame. Recording paper discharge port 96 opens to the left side (FIG. 6) in the upper portion of the upper open frame.

With the above arrangement, heavy recording roll medium 21 can be mounted in the apparatus from the operation side, and recorded paper can be removed to the left side of the operation side, resulting in great convenience. Operation to set the leading end of the recording paper to the nip portion between convey rollers 30 and 31 at the time of recording paper setting is performed from the right side of the apparatus in FIG. 6. However, it is comparatively easy to feed the leading end portion of the light unrolled recording paper while supporting it with guide plate 84, absorber/dryer roller 83 and so on. Since this operation is needed only when the recording paper is to be replaced, it can be allow to access from the left side in FIG. 6 without causing any undesirable result. Convey rollers 30 and 31 and guide plate 84 can be arbitrarily mounted on either the lower or upper frame. If they are mounted in the lower frame, the operation position is stabilized and a high roller position precision required for stable recording paper travel is easily obtained.

Partition plates 65 and 66, electronic cooler 70, water drainage container 71, water discharge pipe 73, and transparent window 102 are provided in the same manner as in the embodiment shown in FIG. 2. The recording paper is surrounded by surrounding members. The interior of the surrounding members is dehumidified to stabilize recording under high humidity. Also, an observation window for observing an image being recorded is formed. The apparatus shown in FIG. 6 is thus provided.

Furthermore, in the embodiment shown in FIG. 6, the upper frame of the clam shell is designed to be lightweight so as to reduce the force required for opening the upper frame, and the projecting amount at the unused time of the tray which receives the cut recording paper is reduced, thereby reducing the size and weight of the entire apparatus. More specifically, in the embodiment shown in FIG. 6, the upper frame is roughly divided into to halves. The auto cutter, the automatic recording paper roll-in storing section, the recording paper guide means, and the recording paper discharge port are arranged in the right half, i.e., in the opposite side of the operation side. The recording paper reception surface is provided at the operation side. As a result, most of the heavy mechanical members are centralized in the vicinity of rotating support shaft 99, and the total weight of the members arranged before the operation side of the frame is small. Therefore, the weight of the frame can be reduced, and the operation force required for opening the upper frame can be greatly reduced.

The present invention has been described with reference to a multi-color image recording apparatus of an electrostatic recording method. However, the present invention is not limited to the specific embodiments described above, and can be applied to other multi-color image recording apparatuses of other recording principles, e.g., an apparatus which uses an electrophotographic sensitized paper. The respective constituent elements of the apparatus, e.g., the arrangement of the recording paper storing section, can be arbitrarily changed.

Various other changes and modifications can be made within the spirit and scope of the invention.

According to the present invention, there is provided an image recording apparatus which uses a recording roll medium, wherein recording paper can be easily removed in units of recorded images, thus resulting in a good operability, and a recording paper portion unnecessarily consumed without image recording can be greatly reduced.

What is claimed is:

1. A multi-color image recording apparatus comprising:

image-forming/processing station means for forming images in a plurality of colors in a superposed manner, in units of individual colors, on an identical unrolled portion of a recording roll medium, in accordance with color image formation data;

recording medium conveying means for reciprocating a plurality of times, when the images in the plurality of colors are to be formed, the identical unrolled portion of the recording roll medium in relation to said image-forming/processing station means, in accordance with formation of the image in the plurality of colors, and conveying a recorded-on unrolled portion of the recording roll medium to a downstream side of said image-forming/processing station means when image formation in the plurality of colors is completed;

recording medium storing means, provided on the downstream side of said image-forming/processing station means, for temporarily storing the unrolled portion of the recording roll medium on which image formation in each of the plurality of colors is to be performed;

recording medium discharging means, provided on the downstream side of said image-forming/processing station means, for discharging the unrolled portion of the recording roll medium on which image formation in each of the plurality of colors has been performed; and switching means, provided on the downstream side of said image-forming/processing station means, which can be switched between first and second positions, the first position being a position for guiding the unrolled portion of the recording roll medium toward said recording medium storing means when image formation in the plurality of colors is performed, and the second position being a position for guiding the unrolled portion of the recording roll medium toward said recording medium discharging means when image formation in the plurality of colors is completed.

2. An apparatus according to claim 1, wherein said recording medium discharging means includes an auto cutter for automatically cutting the unrolled portion of the recording roll medium which is guided toward said discharging means.

3. An apparatus according to claim 2, wherein said switching means is switched to the second position when the final color of said plurality of colors is formed, and said auto cutter cuts a recorded portion of the recording roll medium which is rolled out along with the progress of image formation in the final color.

4. An apparatus according to claim 3, wherein said recording medium conveying means wind back, to an upstream side of said switching means, the unrolled portion of the recording roll medium, after cutting the recorded portion of the recording roll medium.

5. An apparatus according to claim 2, wherein said recording medium storing means is capable of temporarily storing the unrolled portion of the recording roll medium having a predetermined unit length, such as one page, and the unrolled portion of the predetermined unit length of the recording roll medium, on which image formation has been completed, is guided toward said recording medium discharging means by said image-forming/processing means, said switching means, and said recording medium conveying means, and is cut by said auto cutter.

6. An apparatus according to claim 2, wherein said recording medium storing means is capable of temporarily storing an unrolled portion, of the recording roll medium having a length twice a predetermined unit length, such as one page according to a size of recording unit, a first unrolled portion having the predetermined unit length of the recording roll medium, on which image formation has been completed, is guided toward said recording medium discharging means by said image-forming/processing means, said switching means, and said recording medium conveying means, and is cut by said auto cutter, and a second unrolled portion having the predetermined unit length of the recording roll medium, on which image formation has been performed, is left in said recording medium storing means in order to allow formation of a next image on a next unrolled portion having the predetermined unit length of the recording roll medium, the above steps being repeated.

7. An apparatus according to claim 6, wherein, when image formation on the second or next unrolled portion having the predetermined unit length of the recording roll medium is not performed, the first or second unrolled portion of the recording roll medium, on which image formation has been performed, is guided to said recording medium discharging means, and is cut by said auto cutter, and operation of said apparatus is stopped.

8. An apparatus according to claim 1, said apparatus further comprising:

first cutter means, provided on a downstream side of said image-forming/processing means and on an upstream side of said recording medium storing means, said recording medium discharging means, and said switching means, and having a cutting line perpendicular to a conveying direction of the unrolled portion of the recording roll medium; and second cutter means, provided at said recording medium discharging means, and having a cutting line parallel to the conveying direction of the unrolled portion of the recording roll medium.

9. An apparatus according to claim 2, said apparatus further comprising:

housing means having an upper frame, a lower frame, and a shaft for supporting said upper frame to be capable of opening/closing with respect to said lower frame, thus constituting a clam-shell structure; and wherein said apparatus has an operation side opposite to said opening/closing support shaft of said housing means, the recording roll medium and said image-forming/processing station means are sequentially arranged, from the operation side, in said lower frame, and said auto cutter, said recording medium discharging means, and said recording medium storing means are arranged in said upper frame, so that the unrolled portion of the recording medium which is cut by said auto cutter is discharged to the operation side.

10. An apparatus according to claim 9, wherein a recording medium reception member, for receiving the unrolled portion of the recording medium which is to be discharged, is arranged on the operation side of said upper frame.

* * * * *